US007219811B2

(12) United States Patent
Kong

(10) Patent No.: US 7,219,811 B2
(45) Date of Patent: May 22, 2007

(54) BABY FEEDING BOTTLE WITH DRAW TUBE

(76) Inventor: Carl Cheung Tung Kong, 6122 Whittier Blvd., Los Angeles, CA (US) 90022

( * ) Notice: Subject to any disclaimer, the term of this patent is extended or adjusted under 35 U.S.C. 154(b) by 319 days.

(21) Appl. No.: 10/645,648

(22) Filed: Aug. 20, 2003

(65) Prior Publication Data

US 2005/0040128 A1 Feb. 24, 2005

(51) Int. Cl.
*A61J 11/10* (2006.01)
*A61J 9/04* (2006.01)
*A61J 11/00* (2006.01)

(52) U.S. Cl. ..... 215/11.3; 215/11.1; 215/11.6; 215/388; 215/389; 220/705; 220/710

(58) Field of Classification Search ..... 215/11.1, 215/11.3, 11.6, 388, 389; 220/705, 710, 220/706–709; 383/100
See application file for complete search history.

(56) References Cited

U.S. PATENT DOCUMENTS

| | | | | |
|---|---|---|---|---|
| 3,780 | A | 10/1844 | Dupy | |
| 159,197 | A | 1/1875 | Mason | |
| 177,185 | A | 5/1876 | Whitney | |
| 224,557 | A | 2/1880 | Potter | |
| 227,075 | A | 4/1880 | Thompson | |
| 234,224 | A | 11/1880 | Barton | |
| 244,181 | A | 7/1881 | Carpenter | |
| 253,014 | A | 1/1882 | Day | |
| 275,288 | A | 4/1883 | Thomas | |
| 279,935 | A | 6/1883 | Glattsleine | |
| 280,656 | A | 7/1883 | Morris | |
| 323,597 | A | 8/1885 | Prime | |
| 468,759 | A | 2/1892 | Bobrick | |
| 554,071 | A | 2/1896 | Malzen | |
| 593,830 | A | 11/1897 | Borgenschild | |
| 682,464 | A | 9/1901 | Graham-Yooll | |
| 2,133,411 | A * | 10/1938 | Zohe | 215/11.1 |
| 2,469,489 | A | 5/1949 | Allen et al. | |
| 2,520,335 | A | 4/1950 | Piazze | |
| 2,594,114 | A | 4/1952 | Baracate | |
| 2,624,485 | A * | 1/1953 | Boston | 215/11.5 |
| 2,655,279 | A | 10/1953 | Wolf | |
| 2,680,441 | A | 6/1954 | Krammer | |
| 2,756,740 | A | 7/1956 | Deane | |
| 2,760,664 | A | 8/1956 | D'Amico et al. | |
| 2,767,871 | A | 10/1956 | Shapiro | |
| 2,826,324 | A | 3/1958 | Hoag | |
| 2,836,321 | A | 5/1958 | Soltesz et al. | |
| 2,846,103 | A | 8/1958 | Maxwell | |
| 2,876,113 | A | 3/1959 | Barton | |
| 2,954,030 | A | 9/1960 | Jozwiak | |
| 2,996,207 | A | 8/1961 | Witz | |
| 3,044,650 | A | 7/1962 | Oltion et al. | |
| 3,059,797 | A | 10/1962 | Wilkinson et al. | |
| 3,065,873 | A | 11/1962 | Plate | |
| 3,071,272 | A | 1/1963 | Doner | |
| 3,076,574 | A | 2/1963 | Woodbury, Jr. | |
| 3,126,116 | A | 3/1964 | Clinehens | |

(Continued)

*Primary Examiner*—Sue A. Weaver
(74) *Attorney, Agent, or Firm*—Kelly Lowry & Kelley, LLP

(57) ABSTRACT

A baby feeding bottle includes a dispenser body having an upper opening and a hollow interior. A flexible fluid container is supported by the dispenser body. An elongated flow tube has a first end disposed adjacent to the upper opening of the dispenser body and a second end disposed within the flexible fluid container. The flow tube facilitates passage of fluid within the fluid container and to the upper opening of the dispenser body.

13 Claims, 3 Drawing Sheets

U.S. PATENT DOCUMENTS 3,134,494 A 5/1964 Quinn
3,146,904 A 9/1964 Hansen et al.
3,171,571 A 3/1965 Daniels
3,173,566 A 3/1965 Talbert
3,204,855 A 9/1965 Boynton et al.
3,232,467 A 2/1966 Barton
3,243,069 A 3/1966 Duerme
3,247,360 A 4/1966 Ponder
3,263,848 A * 8/1966 Zackheim ..... 215/11.1
3,346,133 A 10/1967 Herdman
3,441,160 A 4/1969 Levy
3,645,414 A 2/1972 Barr
3,648,873 A 3/1972 Grobbel
3,651,973 A 3/1972 Yamauchi
3,661,288 A 5/1972 Noll
3,757,784 A * 9/1973 Avery ..... 604/76
3,770,154 A 11/1973 Johnson
3,946,888 A 3/1976 Tonkin
3,955,698 A 5/1976 Hammer
4,153,170 A 5/1979 Aquarian
4,241,768 A 12/1980 Keller et al.
4,301,934 A 11/1981 Forestal
4,339,046 A 7/1982 Coen
4,411,359 A * 10/1983 Franco ..... 206/217
4,463,859 A 8/1984 Greene
4,615,457 A 10/1986 Harding
4,657,151 A 4/1987 Cabernoch
4,684,032 A 8/1987 Tsay
4,718,778 A * 1/1988 Ichikawa ..... 383/100
4,726,479 A 2/1988 Tsai
4,754,887 A 7/1988 Ou
4,796,767 A 1/1989 McKeown
4,815,615 A 3/1989 Phlaphongphanich
4,821,896 A 4/1989 Cheng
4,830,226 A 5/1989 Kong
4,880,125 A 11/1989 LeBeau
4,898,290 A 2/1990 Cueto
4,925,042 A 5/1990 Chong
4,969,564 A 11/1990 Cohen et al.
4,979,629 A 12/1990 Askerneese
4,994,076 A * 2/1991 Guss ..... 606/236
5,105,956 A 4/1992 Tarng-Lin
5,109,996 A 5/1992 Sullivan
5,211,298 A 5/1993 Bloch
5,261,565 A * 11/1993 Drobish et al. ..... 222/95
5,301,825 A 4/1994 Di Scala et al.
5,377,875 A * 1/1995 Kock et al. ..... 222/95
5,758,787 A * 6/1998 Sheu ..... 215/11.1
5,791,503 A 8/1998 Lyons
6,000,848 A * 12/1999 Massioui ..... 383/80
6,244,452 B1 * 6/2001 Morano et al. ..... 215/11.6
6,257,429 B1 * 7/2001 Kong ..... 215/11.3
6,446,822 B1 * 9/2002 Meyers et al. ..... 215/11.5
6,612,428 B1 * 9/2003 Segovia et al. ..... 206/219

* cited by examiner

BABY FEEDING BOTTLE WITH DRAW TUBE

BACKGROUND OF THE INVENTION

This invention relates generally to drink dispensers, including nursing bottles for infants. More particularly, the present invention relates to a drink dispenser with a flexible draw tube.

Nursing bottles for infants are generally known in the art and typically comprise a resilient nipple mounted onto a cap or neck ring which is adapted in turn for mounting onto a bottle containing a selected beverage or food product in liquid form for an infant. The resilient nipple comprises a soft and collapsible mouthpiece which is manipulated by the infant with an alternating collapsing and expansion motion in combination with a sucking action to draw the liquid contents of the bottle through a nipple port. Nursing bottles of this standard type must be held in an inverted or substantially inverted position during use, to ensure fluid flow communication of the bottle contents to the resilient nipple. Further, such conventional bottles naturally fill with air as the infant drinks the liquid. In turn, the feeding infant tends to swallow some of the air, causing indigestion.

As an improvement on this long existing configuration, a newer generation of baby nursing bottles include a polymeric cylinder into which a collapsible plastic bag or liner can be positioned. The plastic bag is usually secured at the top of the cylinder by a neck ring or the like. The milk, formula or other liquid is then added to the bag rather than to the cylinder or bottle itself. When topped with the appropriate nipple assembly, this arrangement desirably provides a system under which the bag gradually collapses as the infant feeds from the liquid therein. However, because the bag collapses, pockets of the milk, formula or other liquid can be formed which are not easily accessible by the infant as there is no direct path or space available for fluid to flow to the nipple. Increasing suction is required to provide an ever decreasing fluid flow.

Due to the natural inclination of the plastic bag or liner to collapse upon itself and constrict fluid flow as the infant consumes the liquid, the infant child cannot suck fluid from the bottle while in a vertically erect or standing position. This is an ever increasing concern as the child grows and matures and desires to feed from the bottle in a sitting or standing position. In order to provide a constant fluid flow, the child must horizontally recline or arch his or her neck and back to force the fluid towards the nipple of the inverted bottle. However, even in an inverted position, small pockets of fluid can still be formed within the flattening liner and require a great deal of suction to remove.

Morever, these nursing bottles allow air to enter into the liner after the bottle has been put aside, particularly in an upright position such as might be the case when the baby is being burped or otherwise attended to. The weight of the liquid in the liner tends to pull the liner downward drawing air into the liner through the nipple. Air may also be drawn into the liner through the nipple or cap when the baby stops sucking for a period of time. Once the bottle is inverted and the infant begins feeding again, the air travels through the liquid and is trapped in a pocket at the top of the inverted bottle. As the fluid is removed, the air pocket remains at the top of the inverted bottle and can be nearly closed off by the liner as the fluid is removed. If the infant continues to suck after the fluid is removed, air is drawn through the nipple and into the infant causing indigestion.

Bottles have been devised that incorporate plastic bags. For example, U.S. Pat. No. 5,078,287 discloses a plastic bag with a lower rigid support which is manually slid into the cylinder to force the plastic bag upward to remove air out of the bottle. However, this does nothing to solve the problem of pockets of milk, formula or other liquid forming as the plastic bag collapses which denies the infant the ability to consume their full amount of milk, formula or other liquid. In another example, U.S. Pat. No. 3,651,973, bottle incorporates a valve into or otherwise associated with the nipple which is intended to overcome the problems which are brought about when air enters the bottle. However, as fluid is removed from the liner, the liner still collapses upon itself to create a constriction between portions of the fluid which are then difficult if not impossible for the child to access.

Accordingly, there is a need for a simple drink dispenser construction that permits all or nearly all of the liquid to be accessed by the child. There is a further need for a drink dispenser which permits the user to suck liquid easily and smoothly from the drink dispenser in virtually any orientation. There is an additional need for a drink dispenser having an elongated flow or delivery tube to accommodate versatile bottle positioning relative to a resilient nipple member, while insuring substantial liquid flow of the liquid to the infant in response to a normal suction action. There is also a need for a drink dispenser which allows the infant to feed from any angle or position, including an upright standing position. The present invention fulfills these needs and provides other related advantages.

SUMMARY OF THE INVENTION

An improved drink dispenser is provided for facilitating suction-drawn consumption of a beverage or other nutritious liquid therefrom. In a preferred form of the invention, a baby feeding bottle includes a dispenser body having an upper opening and a hollow interior. The dispenser body has a mouthpiece in fluid flow communication with fluid contained within the flexible fluid container. A flexible fluid container is supported by the dispenser body. An elongated flow tube has a first end disposed adjacent to the upper opening of the dispenser body and a second end disposed within the flexible fluid container. The flow tube facilitates passage of fluid within the fluid container and to the upper opening of the dispenser body. The flow tube includes at least one aperture through a sidewall thereof. The flow tube and fluid container are approximately the same length.

In one embodiment, the flow tube or tubes is/are connected to at least a portion of an interior sidewall of the fluid container. In another embodiment, the flow tube extends centrally through the dispenser body and the fluid container. A substantially planar cap plate is disposed adjacent to the upper opening, the cap plate supporting the flow tube and including an aperture in fluid flow communication with the flow tube. A second end of the rigid flow tube includes a spacer.

The baby feeding bottle further includes a casing which engages the dispenser body to enclose the flexible fluid container.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
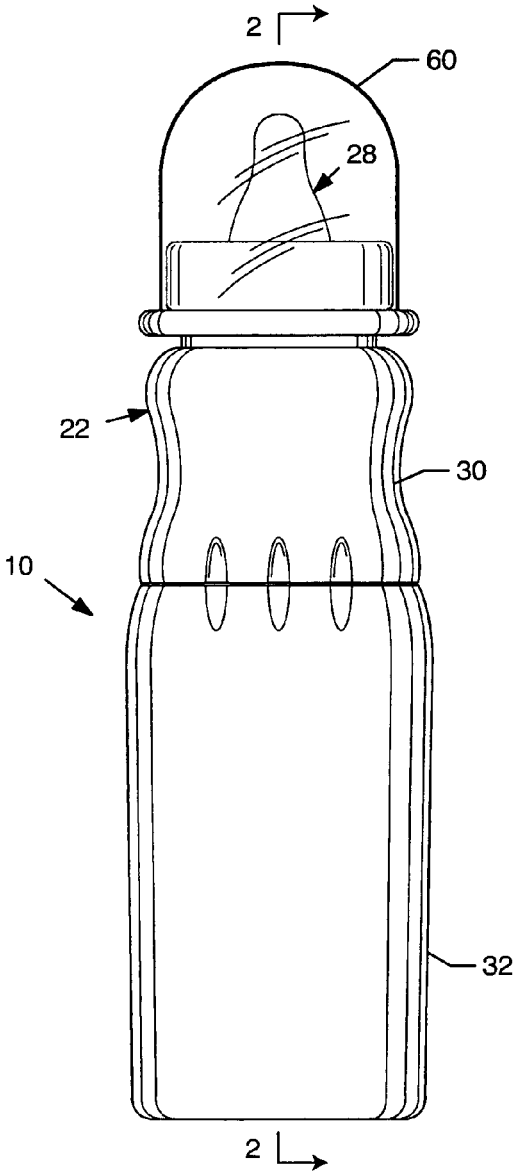
FIG. 1 is a front elevation view of a baby feeding bottle embodying the present invention.

The present invention is a useful drink dispenser construction that permits all or nearly all of the liquid to be accessed by a child. The present invention permits the user to suck liquid easily and smoothly from the drink dispenser in virtually any orientation. The present invention further includes an elongated flow or delivery tube to accommodate versatile bottle positioning relative to a resilient nipple member, while insuring substantial liquid flow of the liquid to the infant in response to a normal suction action. The present invention allows the infant to feed from any angle or position, including an upright standing position. The present invention fulfills these needs and provides other related advantages.

As shown in the drawings for purposes of illustration, the present invention is concerned with a drink dispenser, in the form of a baby feeding bottle 10 seen in FIGS. 1–8.

Each baby feeding bottle 10 includes, generally, a dispenser body 22 that has an upper body opening 24 to permit passage of a fluid to be consumed therethrough. A flexible fluid container 26 is supported by the dispenser body 22. Fluid may be introduced into the flexible fluid container 26 via the upper opening 24. A mouthpiece 28 is provided in fluid flow communication with fluid contained within the flexible fluid container 26.

The dispenser body 22 has a hollow interior and the flexible fluid container extends within the hollow interior of the dispenser body 22. The dispenser body 22 includes an upper casing 30 upon which the flexible fluid container 26 is supported, a lower casing 32, and means 34 for connecting the lower casing 32 to the upper casing 30. The connection means 34 is in the form of a snap-fit connector that permits the lower casing 32 to be joined to the upper casing 30 by a snap fit. In the alternative, the connection means 34 may be in the form of a slide-fit connector that permits the lower casing 32 to be joined to the upper casing 30 by a friction fit. In another alternative, the lower casing 32 may include external threads that may engage internal threads disposed at a lower end of the upper casing 30. A plate (not shown) may also be provided within the lower casing 32 to engage a lower end of the flexible fluid container 26 so that as the lower casing 32 is threaded into the upper casing 30, the plate may engage a lower end of the flexible fluid container 26 to press it upwardly for purposes of expelling unwanted air from within the dispenser body 22.

The flexible fluid container 26 is held in place between the upper casing 30 and a lower portion of the mouthpiece 28 and, when filled with the fluid to be consumed, may extend substantially the entire length of the dispenser body 22. The lower casing 32 is removable so that a user may squeeze the flexible fluid container 26 to manually move fluid therein from being trapped in pockets formed as the fluid container empties to a location within the fluid container 26 where the fluid is accessible to the user.

A lower end of the lower casing 32 is provided an air vent 36 which allows equalization of air pressure within the dispenser body 22 as fluid is consumed and the volume of the flexible fluid container 26 within the dispenser body 22 decreases. The vent 36 also permits water to flow into and out of the casing during normal heating of milk within the container 26.

In the alternative, two sets of numbers, one ascending and the other descending, may be provided on the exterior of the dispenser body 22, which is preferably transparent. These numbers may be provided to permit the user of the baby feeding bottle 10 to ascertain the amount of fluid within the dispenser body 22. For example, when filling the flexible fluid container 26 with a fluid to be consumed, the baby feeding bottle 10 may be held upright and the ascending numbers read to determine the number of fluid ounces within the flexible fluid container 26. Alternatively, the baby feeding bottle 10 may be inverted and the descending numbers read to determine precisely the amount of fluid to be consumed that remains in the baby feeding bottle 10.

The upper end of the upper casing 30 includes a cylindrical and externally threaded neck for receiving a bottle cap 38 which, when threaded onto the upper casing 30, compresses an outer flange 40 of a nipple 42 that forms the mouthpiece 28 referred to above. The nipple 42 includes a cross-valve 43 through which fluid passes to the user. The mouthpiece 28 provides a soft and resilient or natural feel to the infant, while making possible a substantially improved suction-induced liquid flow.

In use, the mouthpiece 28, comprising the bottle cap 38 and the nipple 42, is removed from the upper casing 30 to expose the upper body opening 24. Fluid to be consumed is poured into the flexible fluid container 26 through the upper body opening 24. When the desired amount of fluid to be consumed has been placed into the dispenser body 22, the mouthpiece 28 is replaced atop the upper casing 30.

An elongated flow tube 44 has a first end disposed adjacent to the upper body opening 24 of the dispenser body 22 and a second end disposed within the flexible fluid container 26. The flow tube 44 facilitates passage of fluid within the fluid container 26 and to the upper body opening 24 of the dispenser body 22. The flow tube 44 includes at least one aperture 46 through a sidewall 48 thereof. The sidewall 48 of the flow tube 44 may also include a plurality of apertures 46 spaced along the length of the flow tube 44 between the first and second ends of the flow tube 44. The flow tube 44 and fluid container 26 are approximately the same length. The flow tube 44 is constructed from a relatively rigid yet flexible plastic tubing or the like.

FIGS. 2–5 illustrate an embodiment of the elongated flow tube 44 where the flow tube 44 is connected to an interior sidewall 50 of the fluid container 26. The flow tube 44 may be permanently affixed to the sidewall 50 of the fluid container 26 or, alternatively, the flow tube 44 may be removably attached to the sidewall 50. The removably attachable flow tube 44 may be press-fit into at least one generally U-shaped cradle (not shown) located on an upper portion of the interior sidewall 50 of the flexible fluid container 26, preferably near the upper end of the fluid container 26.

Figure 2:
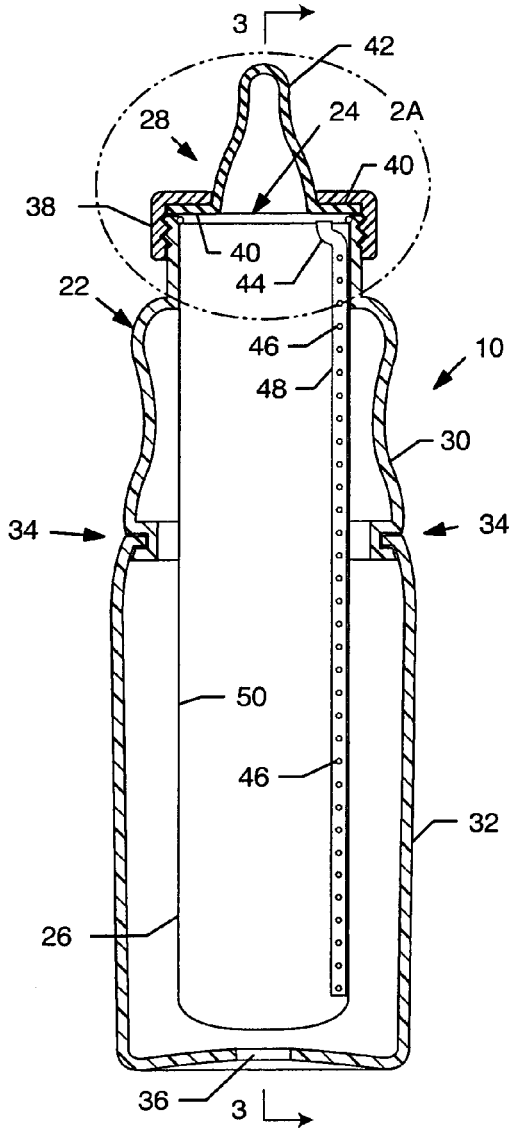
FIG. 2 is a cross-sectional side view of the bottle of FIG. 1.
Figure 2A:
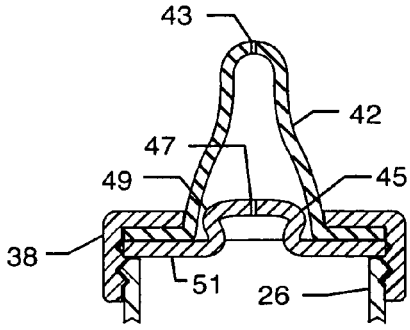
FIG. 2A is a blown-up view of the top of the bottle of FIG. 2.
Figure 3:
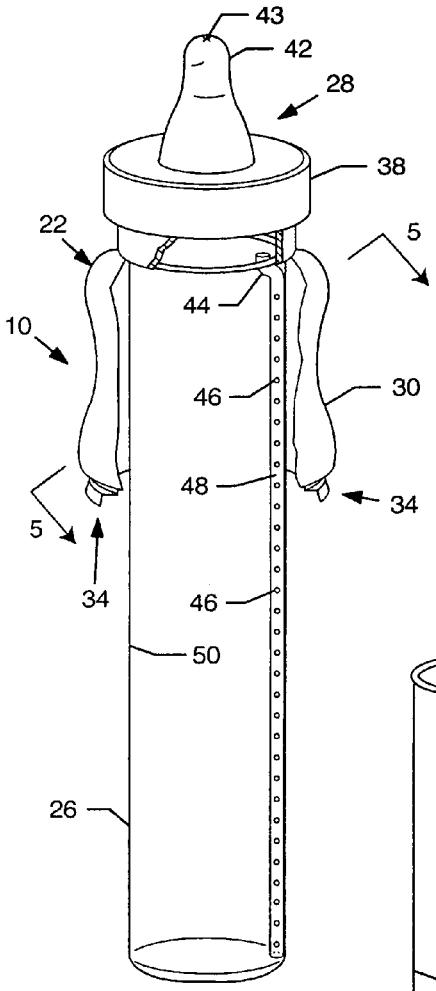
FIG. 3 is a cross-sectional orthogonal view of the bottle of FIG. 2.
Figure 4:
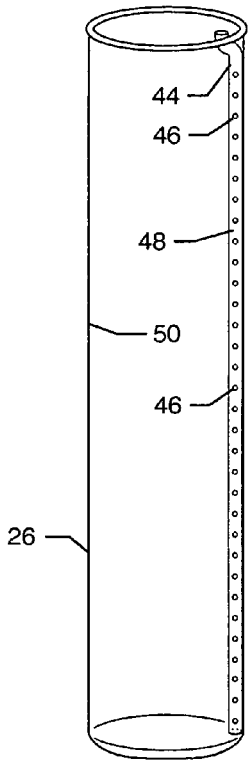
FIG. 4 is an orthogonal view of a flexible container and flow tube embodying the present invention.
Figure 5:
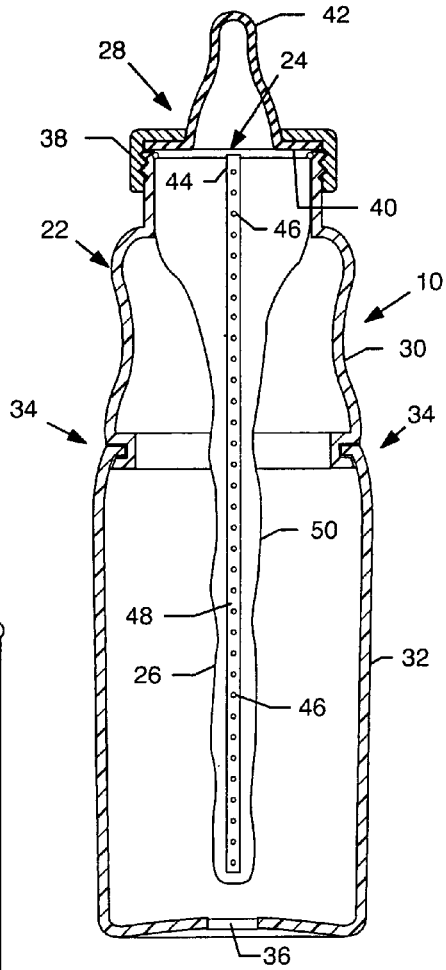
FIG. 5 is a cross-sectional front view of the bottle of FIG. 2 with a collapsed fluid container.

FIG. 2A illustrates a seal 45 located between the top of the fluid container 26 and the nipple 42. The seal 45 includes a central cross-valve 47 through which fluid passes to the user. The seal 45 includes a central portion 49 extending into the nipple 42 and an annular flange 51. There is sufficient space between the top opening of the flow tube 44 and the flange 51 so as to allow fluid to flow to the user through the valves 43, 47.

Figure 6:
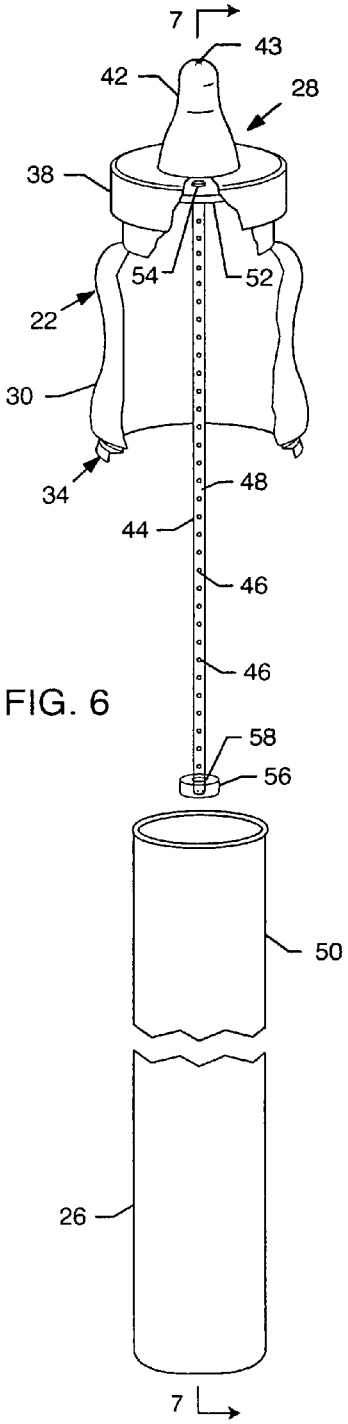
FIG. 6 is an exploded view of another baby feeding bottle embodying the present invention.
Figure 7:
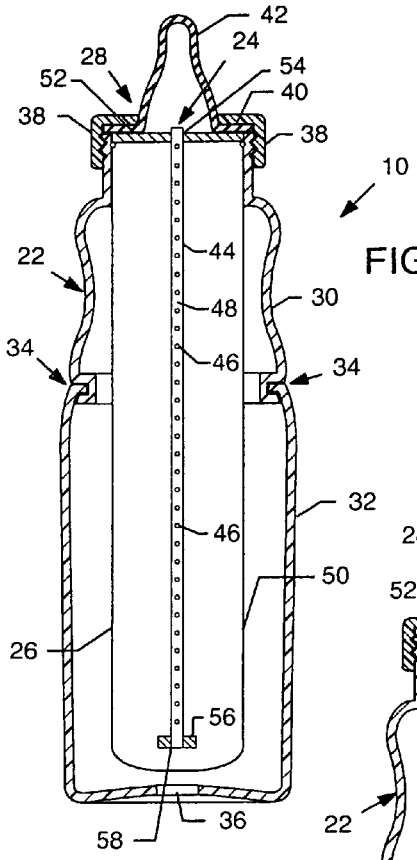
FIG. 7 is a cross-sectional view of the bottle of FIG. 6.
Figure 8:
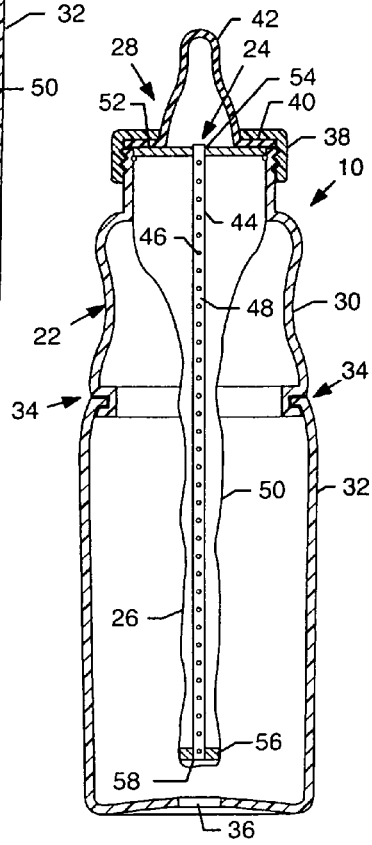
FIG. 8 is a cross-sectional view of the bottle of FIG. 7 with a collapsed fluid container.

FIGS. 6–8 illustrate another embodiment of the elongated flow tube 44 where the flow tube 44 extends centrally through the dispenser body 22 and the fluid container 26. A substantially planar cap plate 52 adjacent the upper body opening 24, between the fluid container 26 and the mouthpiece 28, the cap plate 52 supporting the flow tube 44 and including an aperture 54 in fluid flow communication with the flow tube 44 through which the first end of the fluid tube 44 passes. A second end of the flow tube 44 includes a generally cylindrical spacer 56. The spacer 56 may be of single piece construction with the flow tube 44 or, alternatively, the spacer 56 may include a central aperture 58 which press-fits against the second end of the flow tube 44.

A protective cap 60 may be placed over the top of the baby feeding bottle 10, as seen in FIG. 1.

From the foregoing it will be appreciated that the present invention provides a convenient drink dispenser wherein all or nearly all of the fluid within the baby feeding bottle to be consumed therein to be easily and smoothly withdrawn, such as by sucking on an appropriate mouthpiece. The above-described embodiments are advantageous over existing nursing bottles using collapsible plastic bags as the flexible fluid container collapses as fluid is withdrawn in a manner that still allows all or nearly all of the fluid to be accessible to the user as the fluid tube impedes the premature capture of fluid in pockets which require forceful sucking to remove. The design of the baby feeding bottle further allows the child or infant to drink from the bottle while in an erect or standing position, which is not possible with existing bottles.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A baby feeding bottle, comprising:

a dispenser body having an upper opening and a hollow interior;

a flexible fluid container supported directly by the dispenser body within the interior of the dispenser body; and an elongated flow tube at least partially connected to an interior sidewall of the fluid container, the flow tube having a first end disposed adjacent to the upper opening of the dispenser body, and a second end disposed within the flexible fluid container;

wherein the flow tube facilitates passage of fluid within the fluid container and to the upper opening of the dispenser body.

2. The baby feeding bottle of claim 1, wherein the flow tube includes a plurality of apertures along the flow tube through a sidewall thereof.

3. The baby feeding bottle of claim 1, wherein the dispenser body includes a casing to enclose the flexible fluid container.

4. The baby feeding bottle of claim 1, wherein the flow tube and fluid container are approximately the same length.

5. The baby feeding bottle of claim 1, wherein the dispenser body includes a mouthpiece in fluid flow communication with fluid contained within the flexible fluid container.

6. The baby feeding bottle of claim 1, wherein the flow tube extends through the dispenser body and the fluid container at least partially towards central portions of the dispenser body and the fluid container.

7. The baby feeding bottle of claim 6, wherein the flow tube includes a plurality of apertures along the flow tube through a sidewall thereof.

8. A baby feeding bottle, comprising:

a dispenser body having an upper opening and a hollow interior;

a flexible fluid container supported by the dispenser body within the interior of the dispenser body; and an elongated flow tube connected to an interior sidewall of the fluid container, the flow tube having a first end disposed adjacent to the upper opening of the dispenser body, and a second end disposed within the flexible fluid container;

wherein the flow tube facilitates passage of fluid within the fluid container and to the upper opening of the dispenser body and includes a plurality of apertures along the flow tube through a sidewall thereof, wherein the flow tube and fluid container are approximately the same length.

9. The baby feeding bottle of claim 8, wherein the dispenser body includes a mouthpiece in fluid flow communication with fluid contained within the flexible fluid container.

10. The baby feeding bottle of claim 9, including a casing which engages the dispenser body to enclose the flexible fluid container.

11. A baby feeding bottle, comprising:

a dispenser body having an upper opening and a hollow interior;

a flexible fluid container supported by the dispenser body within the interior of the dispenser body; and an elongated flow tube at least partially connected to an interior sidewall of the fluid container, the flow tube extending through the dispenser body and the fluid container at least partially towards central portions of the dispenser body and the fluid container, the flow tube having first end disposed adjacent to the upper opening of the dispenser body and a second end disposed within the flexible fluid container;

wherein the flow tube facilitates passage of fluid within the fluid container and to the upper opening of the dispenser body and includes a plurality of apertures along the flow tube through a sidewall thereof, and wherein the flow tube and fluid container are approximately the same length.

12. The baby feeding bottle of claim 11, wherein the dispenser body includes a mouthpiece in fluid flow communication with fluid contained within the flexible fluid container.

13. The baby feeding bottle of claim 12, including a casing which engages the dispenser body to enclose the flexible fluid container.

* * * * *